United States Patent [19]

O'Sullivan

[11] Patent Number: 4,511,177

[45] Date of Patent: Apr. 16, 1985

[54] CONVENIENT BABY CHAIR

[76] Inventor: Daniel J. O'Sullivan, 116-40 Park La. S., Kew Gardens, N.Y. 11418

[21] Appl. No.: 403,919

[22] Filed: Jul. 30, 1982

[51] Int. Cl.[3] ..... A47B 83/02

[52] U.S. Cl. ..... 297/136; 297/140

[58] Field of Search ..... 297/136, 138, 140, 141, 297/143; 108/65

[56] References Cited

U.S. PATENT DOCUMENTS

| | | | |
|---|---|---|---|
| 2,540,291 | 2/1951 | Reingold | 297/136 X |
| 2,605,816 | 8/1952 | Vuori | 297/136 X |
| 2,871,920 | 2/1959 | Nichols, Jr. et al. | 297/136 X |

*Primary Examiner*—William E. Lyddane

*Assistant Examiner*—Peter R. Brown

*Attorney, Agent, or Firm*—Hubbell, Cohen, Stiefel & Gross

[57] ABSTRACT

A convenient baby chair comprises a slidable leaf cut from the top of a table and a seating structure secured to the underside of the table top directly beneath the slidable leaf. As the slidable leaf is drawn out from the table top the resulting opening in the table top exposes the seating structure. The seating structure is constructed so that an infant may be seated facing at or away from the table top area. When not in use the slidable leaf can be pushed back into the table top area and, in doing so, it pulls the seating structure close to the underside of the table top to improve the appearance of the table in this position.

4 Claims, 6 Drawing Figures

CONVENIENT BABY CHAIR

BACKGROUND OF THE INVENTION

This invention relates to such chairs as are used to seat infants and small children at mealtimes. Existing baby chairs are usually a tall metal or wooden structure with a small seat, restraining belts and an attached tray area from which the infant is fed. Such a chair is both expensive and very inconvenient to use since it must be near the kitchen table at mealtime and out of the way at other times. The high cost of such a chair is due to the fact that it is not an integral part of the table, but a totally separate unit. Apart from being cumbersome and costly this type of chair also creates a storage problem when the infant outgrows it.

Another type of baby chair consists of a nylon or canvas seat structure attached to a metal framework. The metal framework hooks on to the edge of a table and the infant is fed from the adult eating area. Though this is a less costly chair it creates some new problems. The infant has access to objects on the table within reach and may be inclined to reach for objects on the table out of reach. More important than the inconvenience arising here, the chair has a tendancy to detatch from the table due to the motion of the child. Consequently it is advised that an adult be present when the chair is occupied. Furthermore, since the chair occupies a space at the table it may have to be removed and stored when not in use.

Finally, a storage problem still exists when the infant outgrows the chair.

SUMMARY OF THE INVENTION

Therefore it is the principal object of the present invention to provide a safe, convenient and economical seat for an infant or child at mealtime or otherwise. A further object is to eliminate the storage problem arising when the infant outgrows the seat. This is done by making the seat an integral part of the table.

The chair is designed so that when not in use it does not take up space at or around the table. Nor does it degrade the appearance of the table. Without close examination the chair is barely visible. This overcomes both the temporary and the long term storage problems.

As will be described in the sections that follow a minimum amount of effort is required to prepare the chair for use and to return it to the out of use position making the unit very convenient. Finally, by making the chair a part of the table the materials and construction costs are significantly reduced.

In addition to the above mentioned advantages of my invention another convenience is offered. The infant may be placed in the chair in one of two different seating positions. The first position allows the infant to face inwards toward the table. This will be convenient if the infant is to be fed or supervised while others are at the table at the same time. The second position allows the infant to be seated facing away from the table. This will be convenient if only the infant is to be fed since he or she will be prevented from reaching for objects placed on the table.

BRIEF DESCRIPTION OF THE DRAWINGS

Referring now to the drawings.

DETAILED DESCRIPTION OF THE INVENTION

Figure 1:
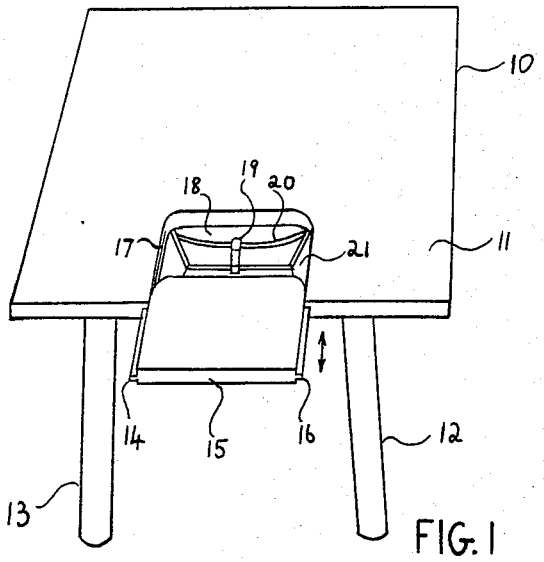
FIG. 1 is a perspective view of a table employing one form of my invention in the ready for use position.

Referring now to FIG. 1 I show a table 10 with table top 11 and legs 12 and 13. A slidable leaf 15 with protruding notches 14 and 16 is cut from the table top 11. A groove 17 which accomodates the left protruding notch 14 is cut in the table top 11 as shown in the figure. An identical groove, though not visible in the figure exists for the right protruding notch 16. This combination of notches and grooves allows the slidable leaf 15 to be slid into and out of the table top 11 as indicated by the arrows.

With the slidable leaf 15 in the position of FIG. 1 an opening 18 exists in the table top 11. A seating structure 21 with attached rear restraining strap 20 and rear leg divider 19 is secured to underneath the table top 11 in a manner which will be described when I refer to FIG. 3.

Figure 2:
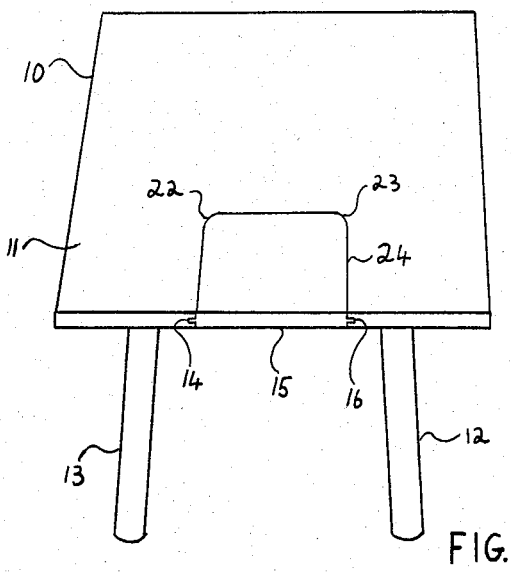
FIG. 2 is a perspective view of a table employing the the form of the invention shown in FIG. 1 in the storage position.

In FIG. 2 I show the slidable leaf 15 fully inserted into the table top 11. In this position only a very fine joining line 24 between the table top 11 and the slidable leaf 15 is visible. The joining line 24 is gradually curved at the corners 22 and 23 due to the cut of the table top 11 and the slidable leaf 15. It will be explained shortly how these corners 22 and 23 make the chair more comfortable.

Figure 3:
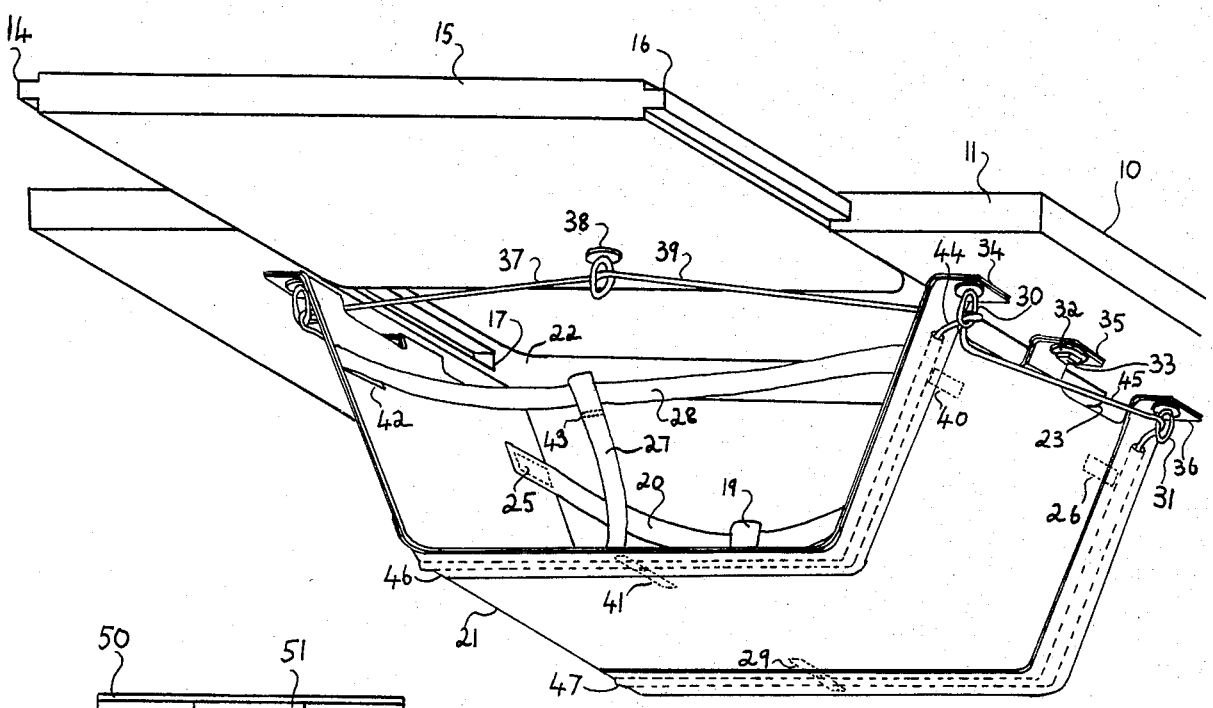
FIG. 3 is an isometric view of the form of the invention shown in FIG. 1.

The seating structure 21 of FIG. 1 is not visible in FIG. 2 This is due to the fact that, in sliding the slidable leaf 15 fully into the table top 11 the seating structure 21 is drawn close to the underside of the table top 11 by an apparatus which is best understood by reference to FIG. 3.

FIG. 3 shows in greater detail the protruding notches 14 and 16 and the groove 17. The seating structure 21 is secured to the right underside of the table top 11 by ring bolt 30 and securing strip 34 at the front, ring bolt 31 and securing strip 36 at the rear and by bolt 33, washer 32 and securing strip 35 at the middle. Details of the ring bolts 30 and 31 will be explained in the paragraph referring to FIG. 4 below. The seating structure 21 is secured to the left underside of the table top 11 in a manner which is identical to the way in which the seating structure 21 is secured to the right underside of the table top 11.

The seating structure 21 can be a durable fabric such as heavy duty nylon or canvas. The rear restraining strap 20 is stitched to the seating structure 21 at the left rear stitch point 25 and at the right rear stitch point 26. The rear leg divider 19 is stitched to the seating structure 21 at the lower stitch point 29. The rear leg divider 19 is also looped around the rear restraining strap 20 and stitched on to itself in such a manner that it can be slid along the rear restraining strap 20.

The front restraining strap 28 is stitched to the seating structure 21 at the left front stitch point 42 and at the right front stitch point 40. The front leg divider 27 is stitched to the seating structure 21 at the lower stitch point 41. The front leg divider 27 is also looped around the front restraining strap 28 and stitched on to itself at stitch point 43 in such a manner that it can be slid along the front restraining strap 28. The rear restraining strap 20, rear leg divider 19, front restraining strap 28 and front leg divider 27 can all be made of a strong durable fabric such as heavy duty canvas or cotton. All stitching on the convenient baby chair can be done with a thick nylon, polyester or cotton thread.

The ring bolt 38 is secured to the underside of the slidable leaf 15. The right side gather rope 39 runs through the ring bolt 38 to the ring bolt 30 where it separates into the front gather rope 44 and the rear gather rope 45. The front gather rope 44 runs through the front gather sleeve 46 as shown in the figure and is stitched to the seating structure 21 at lower stitch point 41. The rear gather rope 45 runs through the rear gather sleeve 47 as shown in the figure and is stitched to the seating structure 21 at lower stitch point 29.

The left side gather rope 37 follows an identical path on the left side of the convenient baby chair as the path followed by the right side gather rope 39 on the right side of the convenient baby chair. The purpose and operation of the left side gather rope 37 and the right side gather rope 39 will be explained in the paragraphs that refer to FIG. 5 and FIG. 6 below. To complete the physical description of the convenient baby chair it is nesessary to refer to FIG. 4.

Figure 4:
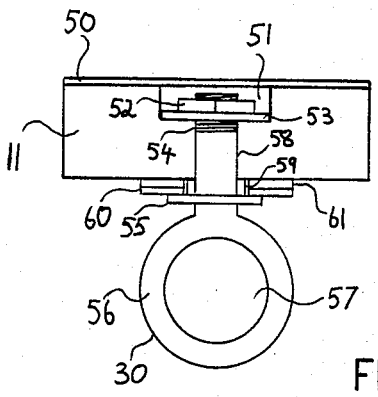
FIG. 4 is a cross-sectional view of a section of the table top shown in FIG. 3 illustrating how the ring bolts of the same figure are secured.

In FIG. 4 I show a small section of a cross-section of the table top 11. The ring bolt 30 consists of a heavy gauge ring 56 around a hole 57 secured to a shaft 58 with a threaded section 54. The securing washer 55 mounted co-axially on the shaft 58 and prevented from movement thereupon presses the lower fabric layer 60 and upper fabric layer 61 against the underside of the table top 11. This acts as a securing post for the upper fabric layer 61 and lower fabric layer 60. The rivet 59 prevents the upper fabric layer 61 and lower fabric layer 60 from tearing under tension. A countersunk area 51 in the table top 11 can accomodate the washer 53 and nut 52 when screwed on to the shaft 58 at the threaded section 54. A thin layer of laminate 50 is glued to the table top 11.

All of the ring bolts illustrated or refered to in FIG. 3 are as shown in FIG. 4. Bolt 33 and washer 32 and the equivalent bolt and washer on the left side of the convenient baby chair are secured to the table top 11 in exactly the same fashion as illustrated in FIG. 4.

Figure 5:
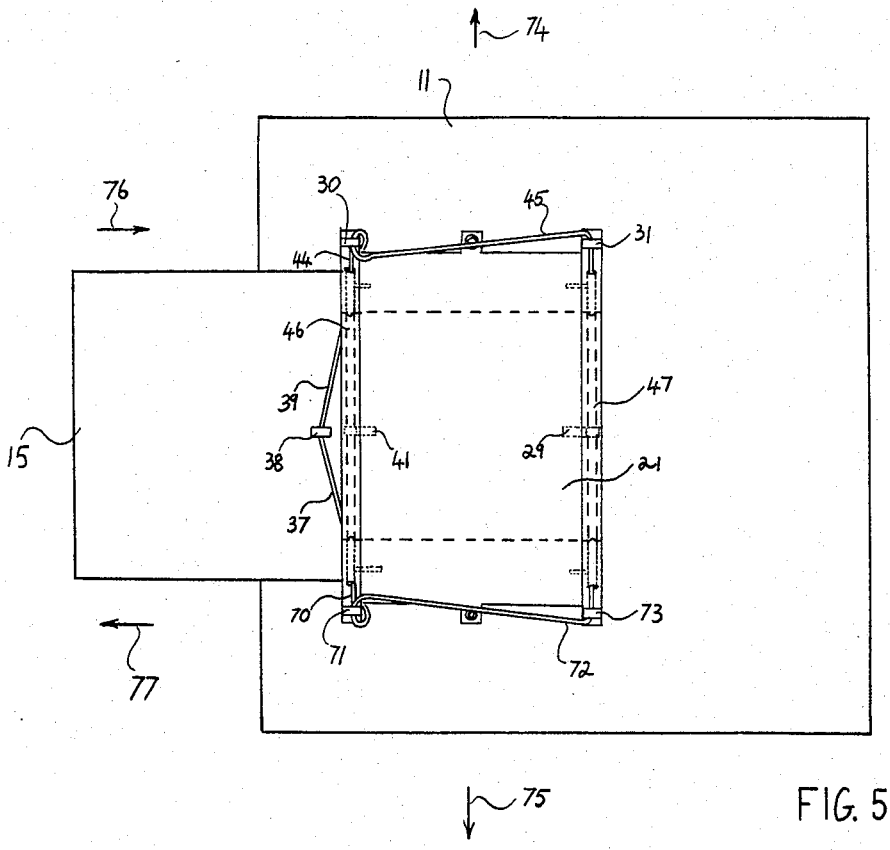
FIG. 5 is a bottom view of the form of the invention shown in FIG. 3.
Figure 6:
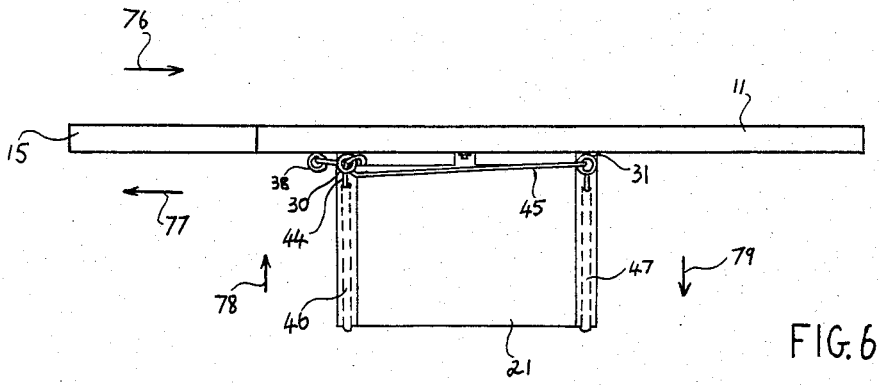
FIG. 6 is a side view of the form of the invention shown in FIG. 3.

Referring now to FIG. 5 and FIG. 6 I will illustrate how the seating structure 21 is pulled close to the table top 11 when the convenient baby chair is not being utilized. With the table top 11 stationary, pushing the slidable leaf 15 in the direction of arrow 76 will cause ring bolt 38, right side gather rope 39 and left side gather rope 37 to move in the same direction. As this happens the front gather rope 44 and the rear gather rope 45 are pulled through ring bolt 30 in the direction of arrow 74 and the front gather rope 70 and the rear gather rope 72 are pulled through ring bolt 71 in the direction of arrow 75. Consequently the rear gather rope 45 is pulled through ring bolt 31 in the direction of arrow 74 and rear gather rope 72 is pulled through ring bolt 73 in the direction of arrow 75. Since the front gather ropes 44 and 70 are stitched to the seating structure 21 at lower stitch point 41 and the rear gather ropes 45 and 72 are stitched to the seating structure 21 at lower stitch point 29, pulling the front gather rope 44 and the rear gather rope 45 in the direction of arrow 74 and the front gather rope 70 and rear gather rope 72 in the direction of arrow 75 will result in the front gather sleeve 46, the rear gather sleeve 47 and the seating structure 21 being pulled towards the table top 11 in the direction indicated by arrow 78. When the slidable leaf 15 is fully inserted into the table top 11 as shown in FIG. 2 the seating structure 21 is pulled close against the underside of the table top 11. Thus, in the position of FIG. 2 the convenient baby chair is scarcely visible and the space it occupies at the table can be used as any other space can.

With the convenient baby chair in the position shown in FIG. 2 it is best to refer again to FIG. 5 and FIG. 6 to demonstrate how the position shown in FIG. 1 is attained.

The slidable leaf 15 is pulled out in the direction of arrow 77 leaving the opening 18 of FIG. 1 in the table top 11. By placing a hand through the opening 18 of FIG. 1 and pushing the seating structure 21 in the direction of arrow 79 the position of FIG. 1 is attained.

All of the gather ropes used in the manufacture of the convenient baby chair can be of strong nylon or cotton fabric. The front gather sleeve 46 and rear gather sleeve are formed by folding the seating structure 21 fabric, cutting along the fold and stitching as shown in FIG. 3, FIG. 5 and FIG. 6.

There are two ways in which an infant may be placed in the convenient baby chair both of which may be best understood by referring to FIG. 3. In the first position the infant faces away from the table 10 with the legs between the front restraining strap 28 and front leg divider 27. Sitting on the seating structure 21 the infant can use the top side of the slidable leaf 15 as an eating area. In the second position the infant faces toward the table 10 with the legs between the rear restraining strap 20 and rear leg divider 19. Sitting on the seating structure 21 the infant can use the table top 11 as an eating area. Since the infants chest will rub against the table top 11 the curve of corners 22 and 23 make the convenient baby chair comfortable.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I believe the nature of my invention, its purpose and its operation will now be clearly understood.

I claim:

1. A convenient baby chair, comprising a slidable leaf cut from a table top and retractable therefrom, an opening in said table top appearing when said slidable leaf is retracted therefrom, a collapsible seating structure secured to said table top underneath said opening, a means for pulling said seating structure close to the underside of said table top when said slidable leaf is fully inserted into said table top and for permitting said seating structure to be occupied by an infant or child when said slidable leaf is fully retracted from said table top, front and rear openings in said seating structure which permit the infant or child to be seated facing at or away from said table top, and front and rear restraining straps and leg dividers mounted across said front and rear openings.

2. A convenient baby chair as recited in claim 1, wherein said seating structure is of a strong durable fabric.

3. A convenient baby chair as recited in claim 1, wherein said means for pulling said seating structure close to said table top includes an arrangement of ropes secured to said seating structure, slidable leaf and the underside of said table top.

4. A convenient baby chair as recited in claim 1, wherein said slidable leaf has left and right protruding notches which mate with left and right grooves in said table top to permit retraction and insertion of said slidable leaf into said table top.

* * * * *